US005967505A

United States Patent [19]

Lin et al.

[11] Patent Number: 5,967,505

[45] Date of Patent: Oct. 19, 1999

[54] AUTOMATIC FEEDER AND INVERTER FOR FABRIC WORKPIECES

[75] Inventors: Wei-Chin Lin, Richardson; Donald L. Klusmann, Garland; Frederick N. Mueller, Mc Kinney; Pedro T. Silva, Dallas; Frank Ch Kim, Coppell; Kent Joell Halland, The Colony; Timothy Matthew Blount, Cedar Hill; Steven Alan Amigh, Dallas, all of Tex.

[73] Assignee: Levi Strauss & Co.

[21] Appl. No.: 08/821,784

[22] Filed: Mar. 21, 1997

[51] Int. Cl.[6] ..... B65H 5/22

[52] U.S. Cl. ..... 271/4.01; 271/7; 271/10.01; 271/65; 271/176; 271/186; 198/399; 112/475.04; 112/475.07

[58] Field of Search ..... 271/4.01, 6, 7, 271/10.01, 10.05, 97, 258.01, 265.01, 291, 298, 65, 176, 185, 186; 198/395, 399, 401; 112/475.04, 475.07

[56] References Cited

U.S. PATENT DOCUMENTS

| | | | |
|---|---|---|---|
| 1,929,361 | 10/1933 | Liljebladh | 271/27 |
| 2,108,702 | 2/1938 | Backhouse | 271/20 |
| 3,280,995 | 10/1966 | Barkley | 214/301 |
| 3,314,676 | 4/1967 | Fromm | 271/26 |
| 3,523,687 | 8/1970 | Petersen et al. | 271/71 |
| 3,622,151 | 11/1971 | Range et al. | 271/74 |
| 3,685,471 | 8/1972 | Reynolds | 271/65 X |

(List continued on next page.)

FOREIGN PATENT DOCUMENTS

| | | | |
|---|---|---|---|
| 0 047 181 A2 | 9/1980 | European Pat. Off. | 27/62 |

OTHER PUBLICATIONS

Xerox Disclosure Journal, vol. 8, No. 5, p. 403, Sep./Oct. 1983.

*Primary Examiner*—David H. Bollinger
*Attorney, Agent, or Firm*—Medlen & Carroll, LLP

[57] ABSTRACT

An apparatus is provided for feeding fabric workpieces one at a time from the top of a stack of like workpieces having a first rough side and a second smooth side, the workpieces being stacked with alternating sides up. A computer controlled picker is used to separate the top workpiece from the remaining workpieces in the stack, and for depositing the workpiece on a downstream conveyor. An ultrasonic face detector is mounted above the first conveyor for determining whether the side of the workpiece facing the face detector—the top surface—is relatively rough or relatively smooth. A pivoting feeder/inverter is provided at the end of the first conveyor. If the workpiece has the desired side up for subsequent sewing operations, the inverter/conveyor is placed in a first position so that the workpiece is directed into a sandwich belt type conveyor which will not change the orientation of the workpiece. If the workpiece has the desired side down, the feeder/inverter is pivoted to a second position to enable the workpiece to enter an inverter conveyor which will rotate the workpiece 180 degrees about an axis along the direction of travel to place the workpiece in the correct orientation for the subsequent sewing operation. Thus, this apparatus takes all of the fabric workpieces from a stack in which the sides facing up alternate, and automatically places all of them in the same orientation prior to arrival at a sewing station.

14 Claims, 9 Drawing Sheets

Microfiche Appendix Included
(1 Microfiche, 57 Pages)

U.S. PATENT DOCUMENTS

| | | | |
|---|---|---|---|
| 3,838,771 | 10/1974 | Whiteford | 198/238 |
| 3,913,906 | 10/1975 | Vits | 271/91 |
| 3,937,457 | 2/1976 | Schwebel | 271/92 |
| 4,002,332 | 1/1977 | Hoenigmann | 271/11 |
| 4,054,285 | 10/1977 | Stange et al. | 271/186 |
| 4,078,789 | 3/1978 | Kittredge et al. | 271/65 |
| 4,200,278 | 4/1980 | Gindri | 271/296 |
| 4,226,324 | 10/1980 | Stocker | 198/405 |
| 4,346,880 | 8/1982 | Roller et al. | 271/186 |
| 4,451,191 | 5/1984 | Torre | 414/118 |
| 4,512,255 | 4/1985 | Crist | 101/230 |
| 4,526,361 | 7/1985 | DuBois | 271/186 |
| 4,566,686 | 1/1986 | Reist | 271/201 |
| 4,568,169 | 2/1986 | Wada et al. | 355/3 SH |
| 4,569,620 | 2/1986 | Lynch | 412/21 |
| 4,669,715 | 6/1987 | Jeschke | 271/65 |
| 4,699,367 | 10/1987 | Russel | 271/65 |
| 4,720,227 | 1/1988 | Eberle | 414/32 |
| 4,759,537 | 7/1988 | Illig et al. | 271/11 |
| 4,763,890 | 8/1988 | Zimmerman et al. | 271/30.1 |
| 4,799,613 | 1/1989 | Adamson | 223/39 |
| 4,968,021 | 11/1990 | Wafford et al. | 271/186 |
| 5,002,267 | 3/1991 | Brecy | 271/9 |
| 5,039,078 | 8/1991 | Blessing et al. | 271/1 |
| 5,041,879 | 8/1991 | Akao et al. | 355/312 |
| 5,106,075 | 4/1992 | Wafford et al. | 271/186 |
| 5,114,132 | 5/1992 | Arato et al. | 271/18.3 |
| 5,845,759 | 12/1998 | Takada et al. | 198/399 |

AUTOMATIC FEEDER AND INVERTER FOR FABRIC WORKPIECES

MICROFICHE APPENDIX

A microfiche appendix consisting of a single microfiche having 57 frames is filed herewith.

FIELD OF THE INVENTION

The present invention relates to fabric handling devices. In particular, the present invention relates to devices for picking a fabric workpiece from the top of a stack of like workpieces, determining the side-up or side-down orientation of the workpiece, and feeding the workpiece through a feeder which will invert the workpieces which are not oriented as desired so that all workpieces leaving the feeder will be oriented in the same way.

BACKGROUND OF THE INVENTION

In the manufacture of clothing it is often necessary to feed small sections or pieces of fabric, called fabric workpieces, into processing machines which edge, sew, and the like. For example, in making dungarees or jeans, the rear seat patch pockets will first be cut as rectangles or polygons of denim, and then singly fed to a machine for hemming the top edge (prior to sewing the patch onto the pants to form the pocket). Or, one leg piece will be fed to a machine for sewing on a fly zipper tape.

Typically fabric pieces will be simultaneously cut from multiple layers on a conventional cutting table, and arrive at the processing machine stacked. The stacks of fabric pieces cut in this manner typically have individual pieces which alternate side up and side down in the stack. Jeans fabric, for example, usually has a rough, dark side and a smooth, light side, and all the pieces must arrive at a sewing station with a proper side up if the assembled jeans are not to be defective.

In the manufacture of jeans, pieces like pocket patches, belt loops and fly material have traditionally been picked off from the stack manually and hand fed into the sewing or processing machine, because existing devices were unable to reliably perform the necessary operations, which are: first, picking up from the stack only the single top piece of fabric (to avoid feeding double pieces to the processing machinery); next, inspecting the pieces to determine which side is facing up; third, flipping those pieces which have the wrong side facing up; and, fourth feeding the individual pieces into the processing machine.

Thus, the need exists for an automated device which can automatically remove fabric parts one at a time from a stack of like parts which alternate side up and side down, determine which side is up, and direct each part through a feeding path or an inverting path so that when all parts arrive at a sewing station they have the desired side up.

SUMMARY OF THE INVENTION

Accordingly, the present invention comprises, in combination, a conventional picker, a face detector for detecting which side of the fabric workpiece is up, and a dual path feeding mechanism which will invert those workpieces in which the desired side is down.

The conventional picker is mounted on hydraulic or pneumatic cylinders, and capable of lateral, vertical, and tilting motions to enable the picker head to engage the leading edge of a workpiece and remove it from a stack of like workpieces. A means for clamping the remaining pieces in the stack, and directing a stream of air between the top and second piece in the stack as the top piece is being removed is provided to reduce the frictional resistance between the top and second piece and to prevent the trailing edge of the second piece from "following" as the top piece is removed. During operation, the top piece is moved away from the stack and deposited on a moving conveyor.

The face detector is located along the conveyor downstream from the picker. The face detector includes a dedicated controller, an ultrasonic transmitter and an ultrasonic detector. The face detector is used to determine whether the side of the fabric facing the ultrasonic detector is relatively smooth or relatively rough. The face detector controller is programmed to use initial calibration readings for calculating a threshold value for determining smooth or rough, and thereafter continuously readjusts the threshold value as workpieces are sensed, whereby differences in fabric surfaces from workpiece to workpiece are compensated for. The face detector controller interfaces with the machine controller which operates the picker, conveyors, and feeder/inverter.

The dual path feeder/inverter includes a twisted-belt inverting conveyor mounted above a conventional conveyor in a housing which pivots about an axis. The housing pivots back and forth to pick up the fabric workpieces from a vacuum conveyor after they have passed under the ultrasonic detector. The housing pivots in one direction if a workpiece has the desired side up, so that the workpiece is directed through the conventional conveyor. The housing pivots in the opposite direction if a workpiece does not have the desired side up, so that the workpiece is directed through the inverting conveyor, or inverter, which rotates the fabric workpiece 180 degrees about an axis along the direction of travel on a twisted interior portion of the belt, so that the fabric workpiece exits the housing with the desired side up.

BRIEF DESCRIPTION OF THE DRAWINGS

The objects, features and advantages of the present invention will become apparent to one skilled in the art from reading the following detailed description in which.

DETAILED DESCRIPTION OF THE PREFERRED EMBODIMENT

Figure 1:
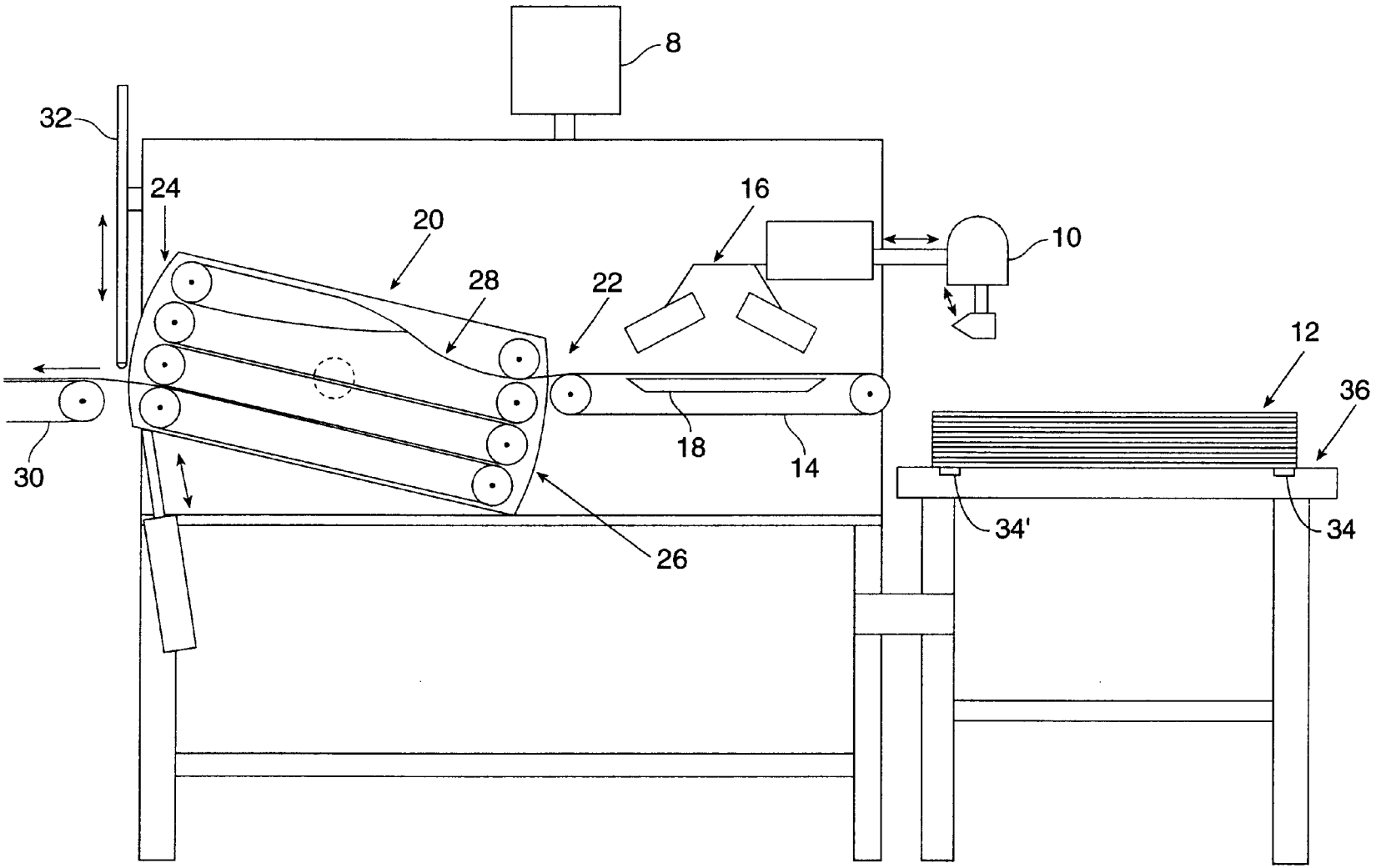
FIG. 1 is a side view showing an automatic feeder of the present invention.

As shown in FIG. 1, the general components of the preferred embodiment of the present invention include an operator control panel 8 which allows the operator to interface with a machine controller, as well as the preferred face detector which has its own dedicated controller. The machine includes a picker 10 for removing a fabric workpiece 11 from the top of a stack 12 of like workpieces, and for transporting the workpiece to an input end 13 of a conveyor 14. The stack of fabric workpieces used for constructing denim garments is typically composed of pieces which have alternating dark/rough and light/smooth sides up. Thus, if a top workpiece has its dark/rough side up, the next piece in the stack will typically have its light/smooth side up. The stack rests upon a table 36 which may be provided with a conveying means (not shown) for moving a plurality of stacks in a direction perpendicular to the direction of feeding shown in FIG. 1, to place them in a position for engagement by the picker 10.

Conveyor 14 is preferably provided with a vacuum portion or zone 18 so that as fabric workpiece 11 is deposited on conveyor 14, the leading edge portion is held securely against the top surface of conveyor 14. Moving downstream, workpiece 11 passes under a face detector 16. Conveyor 14 is preferably constructed with a vacuum source 18 over a central portion of the conveyor belt 14 to securely hold the fabric workpiece flat against the conveyor belt surface. With the fabric workpiece 11 held securely against the top surface of the conveyor belt 14, fabric workpiece 11 is passed under a face detector 16 which determines whether the fabric side facing the detector is smooth or rough. A signal representative of the fabric side facing the detector 16 is transmitted to the machine controller [not shown]. If the expected side is detected, the fabric workpiece is advanced away from the vacuum zone 18 where it can be easily fed into the pivoting feeder/inverter 20.

The pivoting feeder/inverter has a first end 22 for the entry of the fabric workpieces and a second end 24 for the exit of the fabric workpieces. If the fabric workpiece has the desired side up, the first end 22 will be pivoted up so that the leading edge of the fabric workpiece can enter the straight-line conveyor unit 26. If the fabric workpiece has the desired side down, the first end 22 will be pivoted down, as depicted in FIG. 1, so that the leading edge of the fabric workpiece can enter the inverting conveyor 28, which will invert the fabric workpiece 180 degrees about an axis along the direction of travel so that the fabric workpiece exits with the desired side up. Upon exiting the second end 24, the fabric workpiece is taken up by a take-off conveyor 30, which can include a vacuum portion for initially securing the leading edge of the fabric workpiece, and a wiper arm 32 for completely removing the trailing edge of the exiting fabric workpiece to a hanging position until conveyor 30 moves sufficiently to support the entire workpiece. By using a wiper arm 32, any interference between the trailing edge of a long fabric workpiece and the feeder/inverter 20 as it pivots is avoided.

The Picker Assembly

Any conventional picker head can be used with a feeder of the present invention. A variety of different picker heads which are suitable for use in this invention are disclosed in U.S. Pat. No. 5,039,078, which is incorporated herein by reference. The preferred picker head is disclosed in U.S. Pat. No. 5,114,132, which is incorporated herein by reference. A number of sensors are preferably used in conjunction with the picker assembly 10 to allow control of the operation of the picker 10 by the machine controller. Optical sensors 34, 34' are preferably used to detect the presence of a stack 12 of fabric workpieces in position for feeding. If the stack 12 is carried on a platform or tray which rides on a conveyor which may provided in table 36, the sensors 34, 34' will detect the presence of the platform or tray, and a further sensor can be provided to check for the presence of fabric workpieces on the platform or tray. If no fabric workpieces are detected, the machine controller will signal the conveyor in table 36 to advance the next stack, platform or tray into position for feeding, or signal an operator to place a stack in position for feeding.

An optical sensor (or sensors) is preferably provided for checking the path of the picker to make certain there are no obstacles. If an obstacle is detected, a fault signal is sent to the operator, who will clear the obstacle. If no obstacle is detected, the picker 10 advances and is lowered onto the top of the stack 12 adjacent to the leading edge. The picker 10 is moved laterally and vertically using conventional pneumatic or hydraulic cylinders.

A sensor is also preferably provided on the picker 10 to provide a control signal to indicate contact with the top workpiece 11. The machine controller directs the picker 10 to secure the top piece; in the preferred embodiment this is done by extending needles into the fabric, and slightly tilting the pickhead. A sensor can, likewise, be provided to furnish a control signal when the pickhead is tilted.

A clamp is preferably extended to hold the leading edge of the next piece in the stack, a blast of air is blown to separate the top workpiece from the rest of the stack, and the picker 10 moves up, away from the stack, and towards conveyor 14. Sensors may be provided to insure that the clamp is in a proper position, and not in a position to block movement of the picker. A sensor, such as, for example, a proximity sensor, can be provided so that, when the end of the stack is reached, and the clamp extends over the tray or platform surface, a control signal is sent to the machine controller, which can then advance the next stack into position Sensors are preferably provided for signaling the position of the pick head when it reaches the top of its normal position, and when it reaches a predetermined position for depositing the leading edge of fabric workpiece 11 onto conveyor 14. When the predetermined position over conveyor 14 is reached, the machine controller directs the picker 10 to contract the needles and a short blast of air is released to drop the fabric workpiece onto the conveyor 14. The picker 10 is then moved back to a position over the stack in preparation for picking the next workpiece.

First Conveyor

Conveyor 14 is preferably provided with slight suction to help hold the fabric workpiece flat. This can be provided, for example, by a vacuum plenum 18 disposed under a perforated (or air permeable) conveyor belt. A proximity sensor can be provided upstream of the face detector 16 to make certain that only one workpiece was pulled by the picker 10. If a workpiece having double thickness or greater is sensed, a fault can be signalled and the machine stopped to permit the operator to clear the defect.

Face Detector

Figure 2:
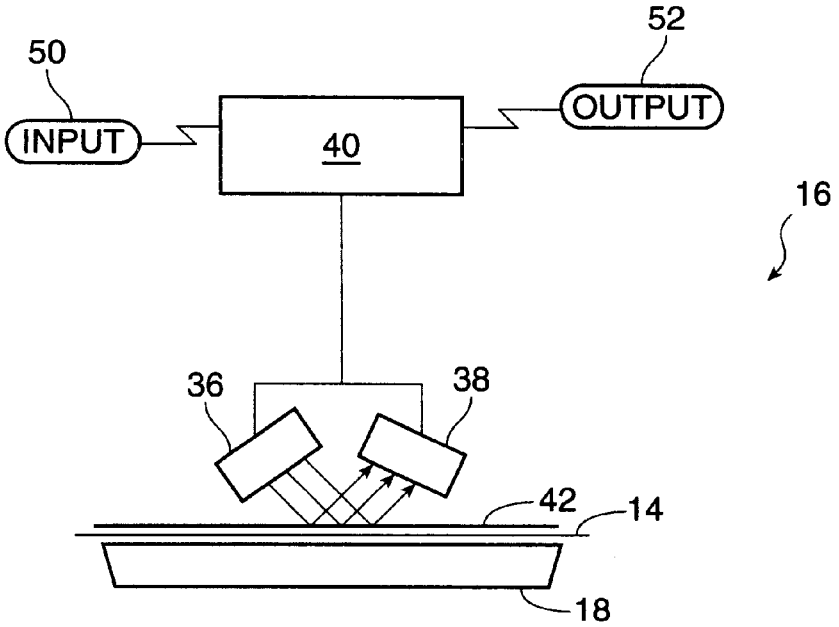
FIG. 2 shows a diagram of an ultrasonic face detector of the present invention.

As shown in more detail in FIG. 2, the preferred face detector of the present invention includes an ultrasonic transmitter 36, an ultrasonic receiver 38, and a detector controller 40. The preferred transmitter and receiver are manufactured by Baumer Electric, Ltd. (Switzerland), as part number USDK 30D9001 (transmitter) and UEDK 30U9198 (receiver). Baumer's USDK 30D9001 transmitter provides a sonic beam having a frequency of 220 kHz at a sonic beam angle of about 10 degrees, and operates on a supply voltage of about 12–30 volts direct current (D.C.). Baumer's UEDK 30U9198 receiver provides an operating range of 20 to 200 mm for receiving a sonic beam having a frequency of about 220 kHz and a sonic beam angle of about 10 degrees. Powered by 12 to 30 volts DC, this receiver provides an analog signal of from 0 to 5 volts D.C.

The ultrasonic transmitter continuously generates an ultrasonic beam which is reflected off the surface beneath the transmitter; the reflected beam is detected by the receiver which generates a voltage which is proportional to the strength of the reflected signal. If the transmitted beam reflects off a perfectly smooth surface which reflects virtually all of the transmitted beam, the receiver should generate about a 10 volt signal. If the surface is so rough that the transmitted beam is substantially absorbed or scattered by the surface beneath, the receiver will generate low to no volts. Thus, a relatively high voltage signal from the ultrasonic receiver represents a facing surface 42 which is smooth, while a relatively low voltage signal from the ultrasonic receiver represents a facing surface 42 which is rough.

When the face detector 16 is initially placed into operation, it is necessary to calibrate it so that the detector controller can create a threshold value for comparison with any given measured signal to determine whether the side 42 of the fabric workpiece which sides the transmitter 36 and receiver 38 is smooth or rough. The "rough" and "smooth" characteristics will vary from one fabric to another, and, with the same kind of fabric, from one lot to another. Accordingly, the detector controller has been provided with instructions which will enable it to learn the difference, and to self-adjust a threshold value which it creates during calibration. The preferred source code for performing this task is attached as Appendix A to this specification.

Figure 4A:
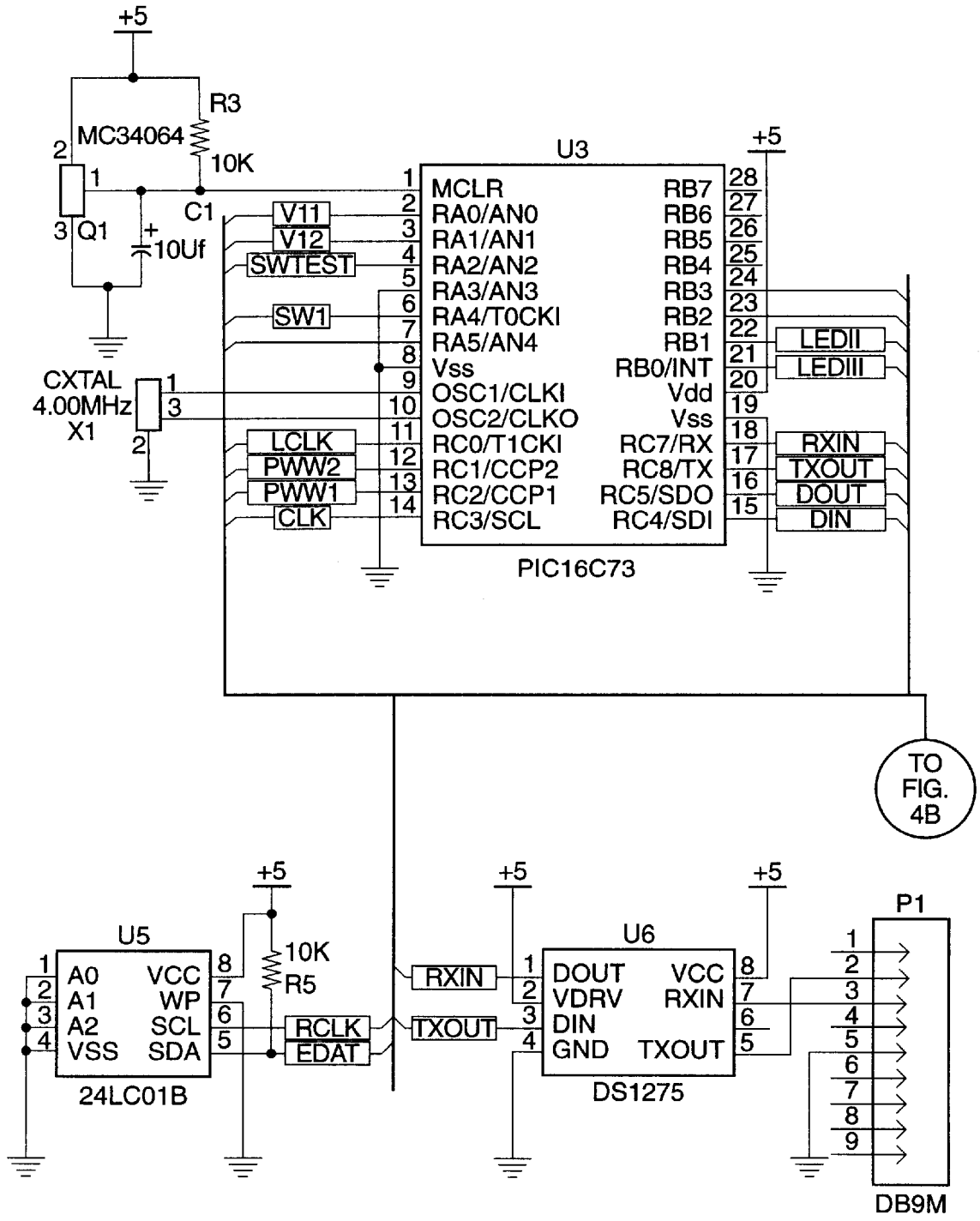
FIGS. 4–6 are circuit diagrams illustrating electronic circuits used in conjunction with a face detector controller used for controlling the ultrasonic face detector.
Figure 4B:
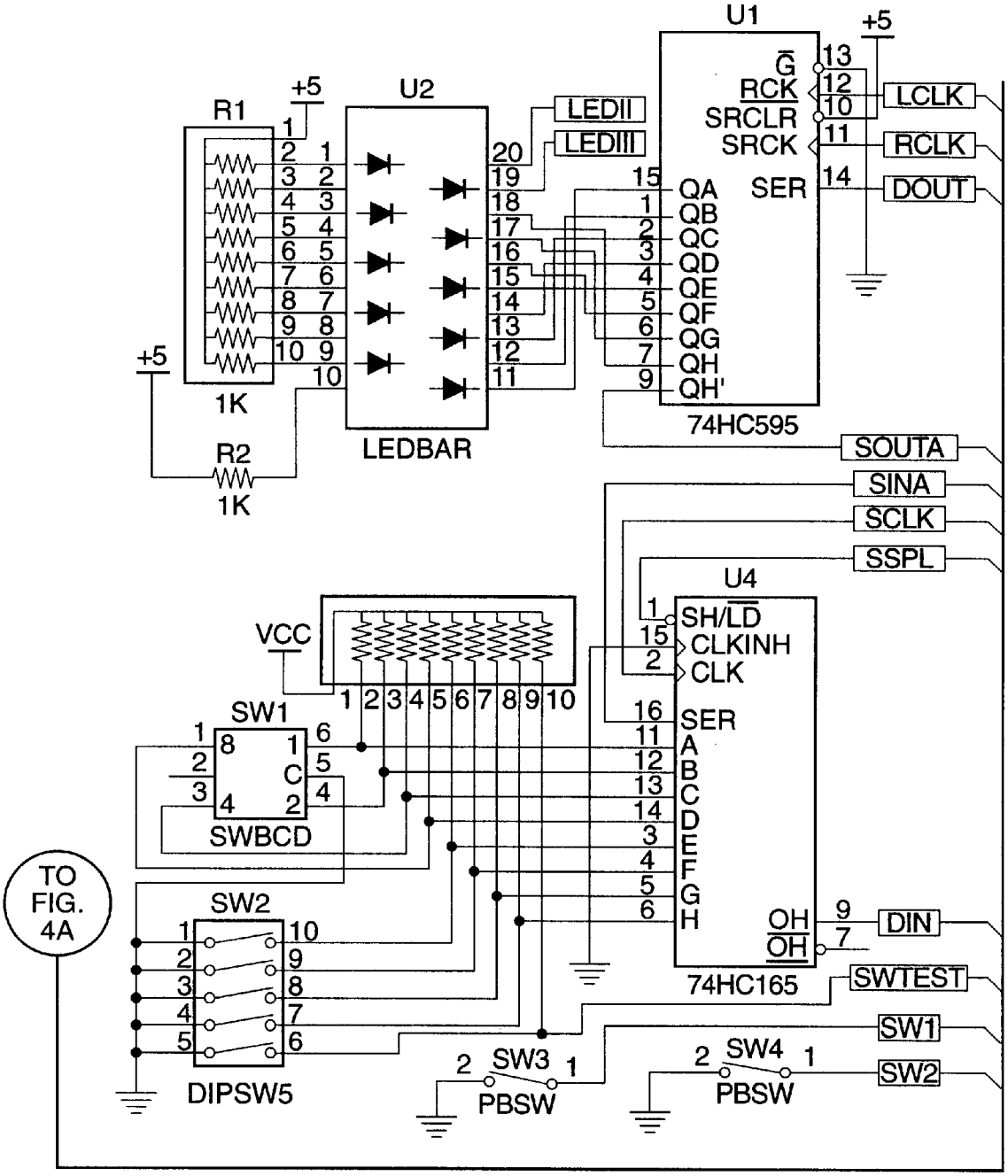

One or more calibration switches, shown in FIG. 4 as SW3 and SW4, are provided to enable the operator to calibrate the face detector 16. The operator places a fabric workpiece beneath the detector 16, and then both switches are pressed and held to provide a signal to the detector controller that calibration will commence. The detector 16 will take a few seconds to find the proper calibrate level of the material. A bar graph can indicate the approximate calibration level found. Both switches are released. The material is turned over and again placed under the detector. Both switches are depressed, and the detector 16 takes a few seconds to find the proper calibrate level of the material on the second side. Using these two measurements, the detector controller generates an average value which it uses to set a threshold. Once this has been done, production can begin.

Figure 3:
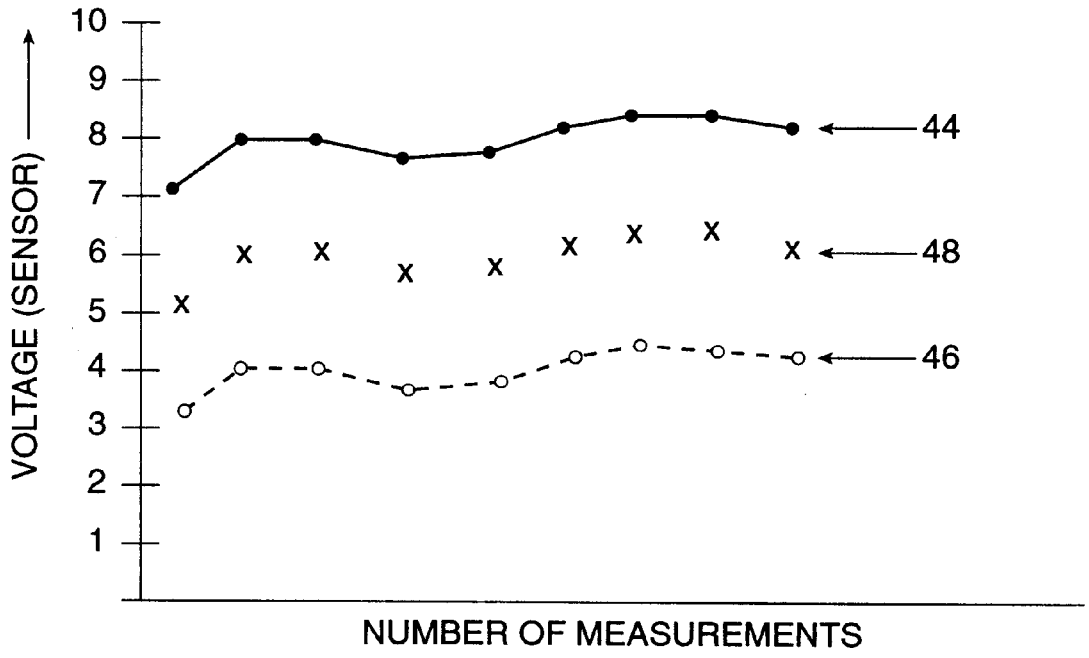
FIG. 3 shows a graph illustrating the calibration and self-teaching facility of an ultrasonic face detector of the present invention.

As pieces are passed under the face detector, differences between the smooth surfaces and rough surfaces will cause fluctuations of the voltages generated by the receiver 38. However, the detector controller will continuously recalculate the threshold value, thus enabling the invention to accurately detect which side is up regardless of the minor differences between the individual workpieces. This process is illustrated by FIG. 3, which shows smooth side data points at line 44, rough side data points at line 46, and the calculated threshold used to determine the condition of the next piece at line 48.

In the preferred embodiment, when a bundle of workpieces has been completed, and a new bundle is about to be fed through the face detector, the controller will average the starting threshold value and the ending threshold value of the finished bundle to calculate a new starting threshold value for the next bundle.

As shown in FIG. 2, communications with the machine controller is established by a detector controller input 50 and a detector controller output 52. For each fabric workpiece which passes under face detector 16, a signal is generated by detector controller 40 which designates whether the rough side is up or the smooth side is up. If the machine controller expects the rough side to be up, and the detector controller confirms this state, then the fabric workpiece continues downstream. If the machine controller expects the rough side to be up, and the detector controller 40 determines that the smooth side is up, then one of several actions can be taken. The machine controller can stop the machine, and alert the operator to the fault. The operator can then remove the workpiece and restart the machine. Alternatively, the machine can compensate by manipulation of the downstream feeder/inverter 20.

If the smooth side of the fabric workpiece contains a slight flaw, it is possible that the beam will reflect off that flaw and produce a "rough" signal. To limit the possibility of such an erroneous signal, and to improve accuracy, it is most preferred to connect two separated transmitter/receiver pairs to the detector controller 40. The signals from each pair can be compared by the detector controller. If a smooth side is expected, and at least one detector provides a smooth signal, then the side up is substantially likely to be smooth.

Figure 5:
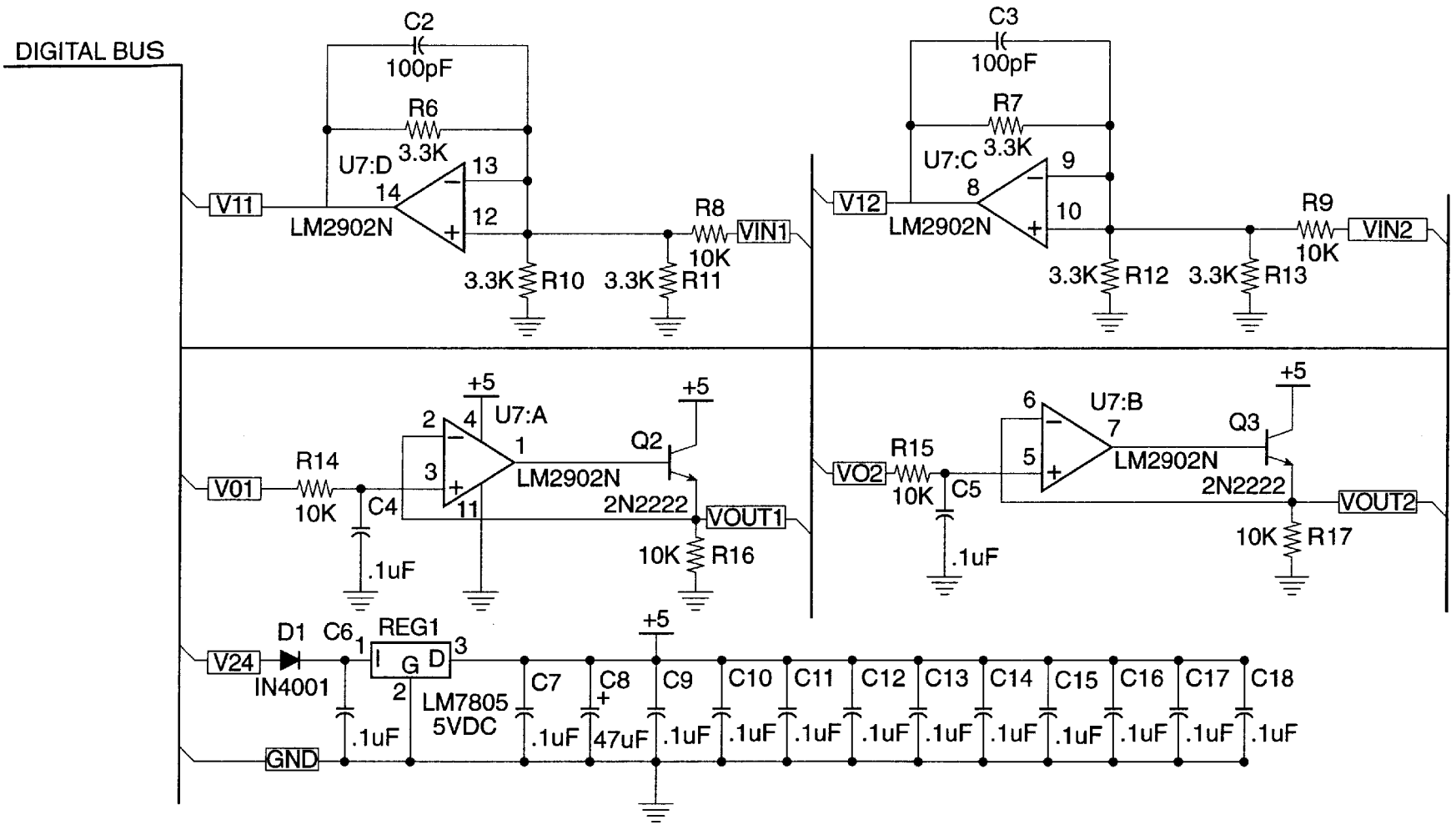
Figure 6A:
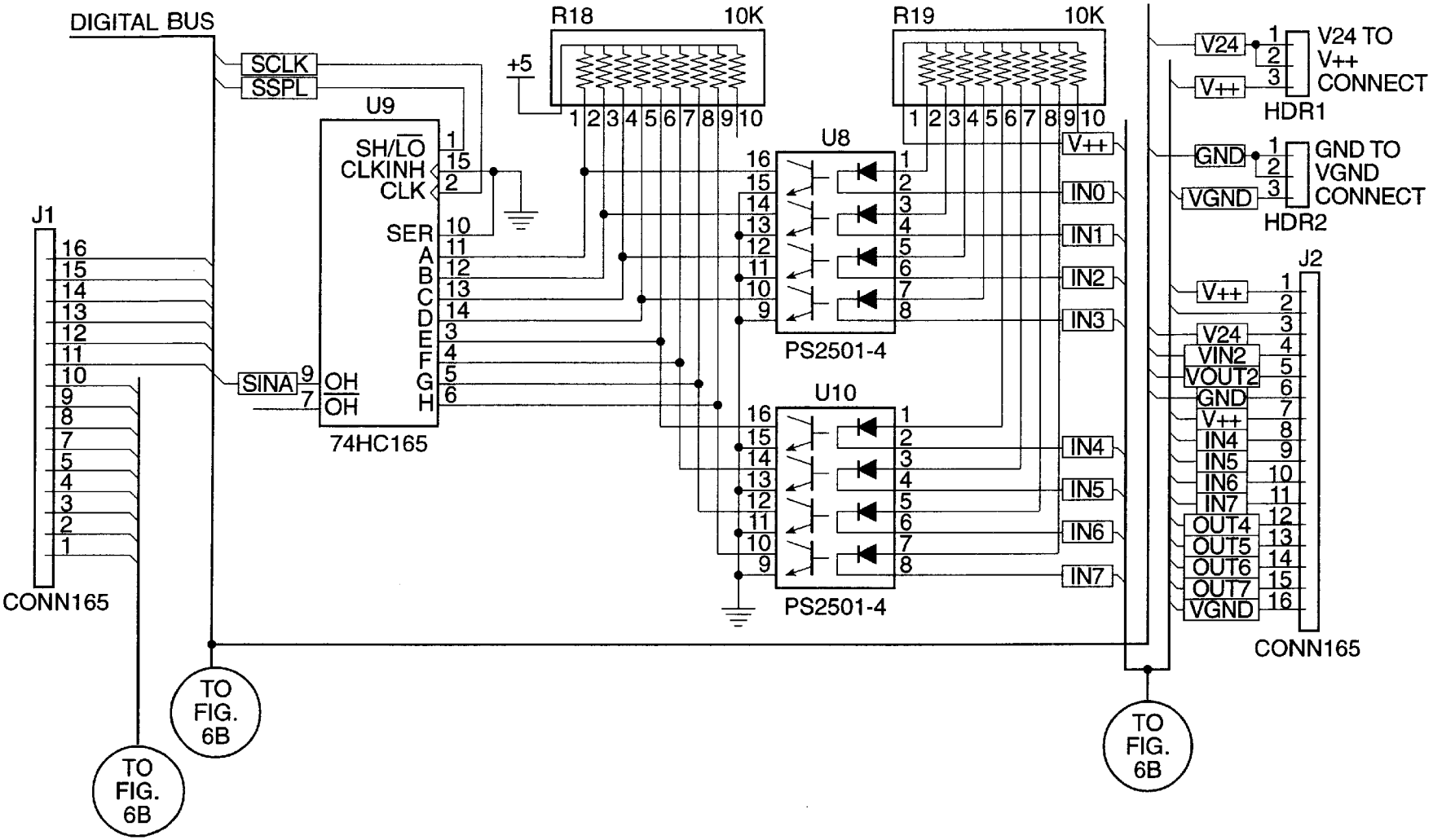
Figure 6B:
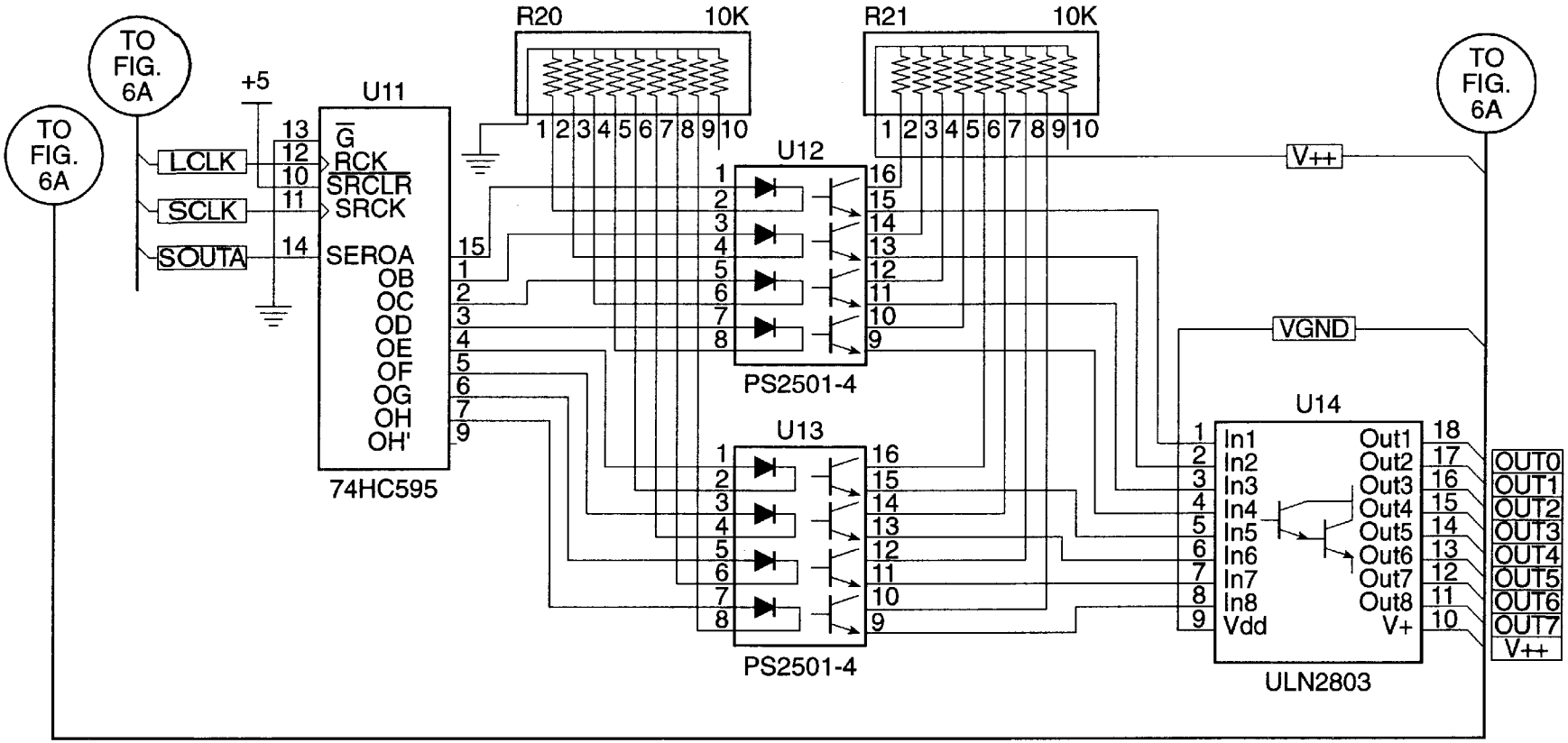

As shown in FIGS. 3–5, the heart of the control electronics for the face detector 16 is preferably a PIC16C73 microcontroller from Microchip Technology, Inc. The controller 40 is a RISC-like CPU with 22 input/output pins (5 capable of Analog-to-Digital conversion). The controller 40 will interface with the I/O's, bargraph, dipswitch etc. by serial shift registers due to pinout limitations. A serial EEPROM will also be available for saving parameters during power downs. The electronics provide the control needed to adjust the face detector 16 for calibration as well as real-time fine tuning. While the power requirements are 24 Volt DC @ 100 mA(max), a 5 volt DC regulator provides all voltage for internal circuits. Two 16 pin connectors are provided for all signals, each pin assigned as follows:

| Connector 1 | Connector 2 |
|---|---|
| 1 - 24 VDC Power | 1 - 24 VDC Power (Isolated) |
| 2 - Ground Power | 2 - Ground Power (Isolated) |
| 3 - 24 VDC to Ultrasonic Sensor 1 | 3 - 24 VDC to Sensor 2 |
| 4 - Output from Sensor 1 | 4 - Output from Sensor 2 |
| 5 - Control to Sensor 1 | 5 - Control to Sensor 2 |
| 6 - Ground to Sensor 1 | 6 - GND to Sensor 2 |
| 7 - 24 VDC (Isolated) | 7 - 24 VDC (Isolated) |
| 8 - Input - Material Present 1 | 8 - Input - Material Present 2 |
| 9 - Input - New Bundle 1 | 9 - Input - New Bundle 2 |
| 10 - Input - Not Defined | 10 - Input - Not Defined |
| 11 - Input - Not Defined | 11 - Input - Not Defined |
| 12 - Output - Face 1 | 12 - Output - Face 2 |
| 13 - Output - Face 1 inverted | 13 - Output - Face 2 Inverted |
| 14 - Output - Not Defined | 14 - Output - Not Defined |
| 15 - Output - Not defined | 15 - Output - Not Defined |
| 16 - Ground (Isolated) | 16 - Ground (Isolated) |

For normal operation:

1. The New Bundle input is set to 0 VDC and then released to 24 VDC (minimum pulse width≧50 mSec) to indicate the start of a new bundle.
2. When the material is under the face detector, a Material Present input is set to 0 VDC. The detector will sample the sensor at a 5 mS rate and build up an average signal for the material. The detector controller will set the Face Output as soon as enough samples have been taken. The Fide Output may change several times as the detector continues to sample the material and update the output.
3. Before the material is no longer under the detector, the Material Present Input (24 VDC) is released. This will prevent misreads from the detector. The detector will freeze the Face Output at this time and wait for the next Material Present Input.

4. Steps 2 and 3 are automatically repeated for each fabric workpiece in the bundle.
6. Step 2–4 are automatically repeated at the start of a new bundle.

The presence of material under the detector (step 3 above) and the approaching passage of the trailing end of a workpiece under the detector (step 4 above) can be determined by optical sensors positioned slightly downstream (step 3) and slightly upstream (step 4) of the face detector, and operatively linked to the face detector controller 40 either directly or through the machine controller.

The Feeder/Inverter

Figure 7:
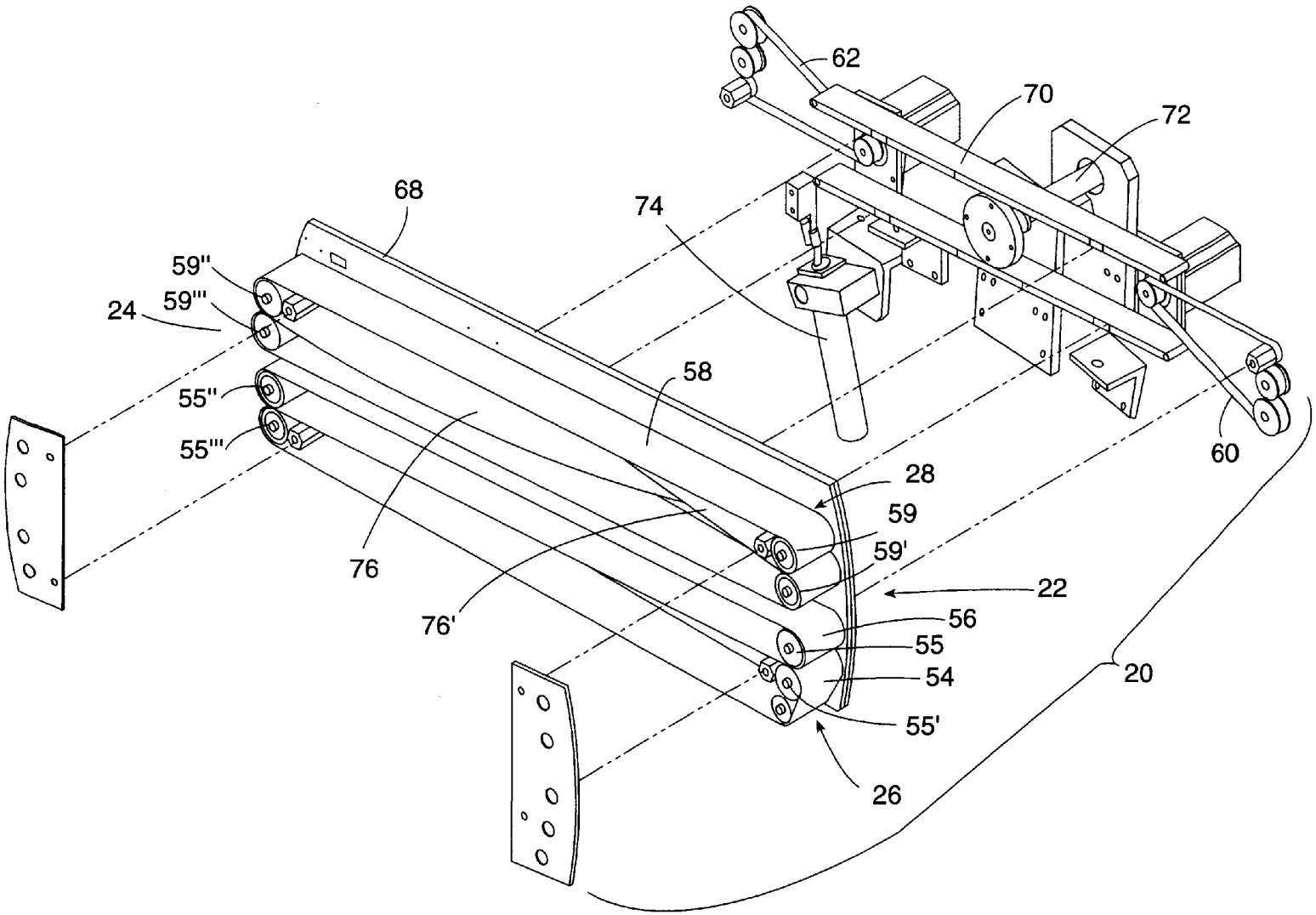
FIG. 7 is an exploded perspective view of a pivoting dual path feeding mechanism of the present invention.

The feeder/inverter 20 is shown in detail in FIGS. 7–10. As shown in FIG. 7, the feeder/inverter 20 includes a straight line conveyor 26 which is preferably formed from a pair of sandwich belts comprising a first driven belt 54 which passes over and is driven by roller 55 and 55", and a second driven belt 56 which passes over and is driven by rollers 55' and 55"'. The rollers 55, 55' and belts 54, 56 form an entry nip at end 22 of the straight line conveyor 26, and the rollers 55", 55"' and belts 54, 56 form an exit nip at end 24 of the straight line conveyor 26. Thus, an object being conveyed on straight line conveyor 26 enters the nip between the rollers 55, 55' at end 58, is transported between the two belts 54 and 56, and exits the conveyor 26 at end 60.

The rollers 55, 55', 55", 55"' of the straight line conveyor can be driven by any conventional drive mechanism, such as, for example, a motor-driven belt or chain drive 60. It should be understood that the belts and roller surfaces used in this invention may be complementarily ribbed in the manner of auto engine drive shaft belts, or have other means for preventing slipping, should the application demand this. Likewise, the outer surfaces of the belts may be textured with ribs, nubs, waves, fingers, etc., or, these surfaces may have complementary mating patterns such as gear-like teeth for driving and/or meshing the belts together.

Figure 8:
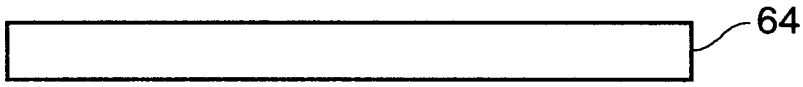
FIG. 8 is a top view of a strip of belting material used to construct the inverting belt.
Figure 9:
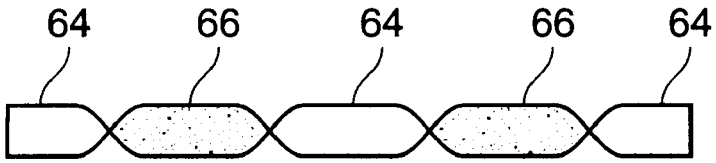
FIG. 9 is a top view of a strip of belting material used to construct the inverting belt which has been given two full (360 degree) twists; and, FIG. 10 is a side view of a completed inverting belt, showing its orientation when placed on the rollers of the dual path feeding mechanism.
Figure 10:
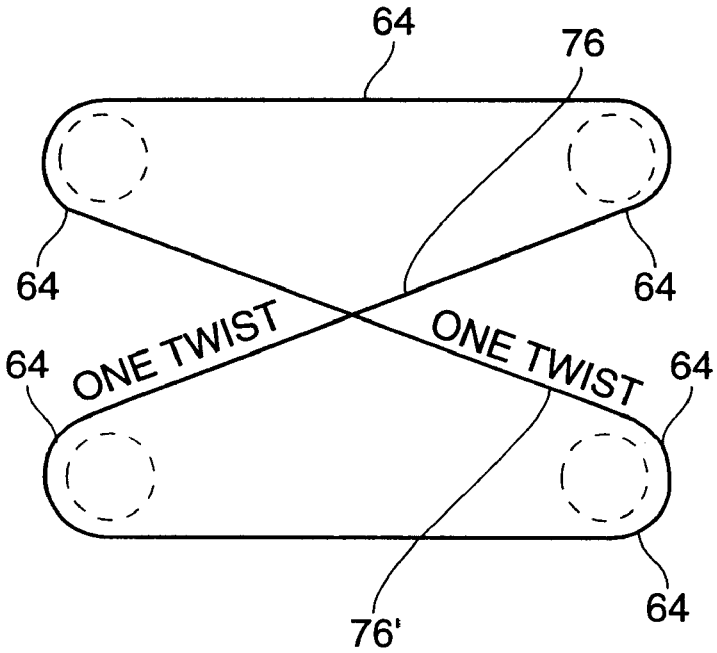

The feeder/inverter 20 also includes an inverting conveyor 28. Inverting conveyor 28 can be produced as described in U.S. Pat. No. 5,039,078. However, inverting conveyor 28 is most preferably produced using a single driven belt 58 which is formed and mounted on the rollers 59, 59', 59", and 59"' as shown in FIGS. 8–10. As shown in FIG. 8, belt 58 is formed from a strip of belting material having a first side 64 and a second side (not shown). As shown in FIG. 9, one end of belt 58 is held stationary and the other end is twisted through 360 degrees twice, to place two full twists into the belt 58. This exposes both the first side 64 and the second side 66 of the belt. As shown in FIG. 10, the two ends of the belt 58 are fused together to form a single, endless belt, and the belt is oriented on the rollers 59, 59', 59", and 59"' as shown to form two twisted belt segments which form an entry nip between rollers 59, 59' and an exit nip between rollers 59" and 59"', and which rotate 180 degrees between end 22 and end 24.

Referring again to FIG. 7, the leading edge of a fabric workpiece enters the nip between rollers 59 and 59' at end 22 with a first side up, and, held between the two twisted belt segments 76, 76', is rotated 180 degrees about an axis along the direction of travel, exiting through the nip formed between rollers 59" and 59"' at end 24 with the first side down.

The straight line conveyer 26 and inverting conveyor 28 can be conveniently mounted for operation on plate 68, which is, in turn, mounted on a bracket 70. A rotatable axle 72 can be operatively joined to bracket 70 to enable the entire feeder/inverter 20 to rotate in either direction around a central longitudinal axis passing through axle 72. An arm 74 which can be driven to provide linear motion is attached to an end of the feeder/inverter 20 to effect a limited rotation of the feeder/inverter about the axle 72 by pushing end 24 up and pulling end 24 down. A pneumatic cylinder rod provides the preferred arm 74; however, other conventional means can be used, such as, for example, a hydraulic cylinder, a machine driven piston, or the like. Alternatively, conventional means for directly rotating the axle, such as a chain or cable drive, can be used to effect the rotation of the feeder/inverter. Sensors can be used to provide control signals for feedback to the machine controller to indicate the position of rod of drive cylinder 74 and/or end 24.

Second Conveyor

Conveyor 30 is preferably provided with a slight, partial vacuum to help hold the fabric workpiece in position on the conveyor and to assist in completely removing the workpiece from the output end 24 of the feeder/inverter 20. A clamp or picker head may be used, if desired, to secure the leading edge of a fabric workpiece in position on the conveyor 30 when the wiper 32, shown in FIG. 1, is activated to clear the trailing end from the feeder/inverter 20.

Operation of the Preferred Embodiment

Assume it is desired for a particular operation that all workpieces should be delivered to a downstream sewing station with the dark (rough) side up. A stack of workpieces is delivered to the input end of the present invention by a conveyor. When the stack is in the proper position for feeding, the picker head 10 advances, drops, extends its needles and tilts to secure the top workpiece in the stack. The picker head raises the leading edge of the workpiece, a holddown clamp comes down on the leading edge of the remaining pieces in the stack, and a blast of air directed between the bottom surface of the top workpiece and the top surface of the second workpiece in the stack separates the top workpiece from the stack, enabling the top workpiece to be removed. The picker head moves back towards conveyor 14 until it reaches a predetermined position, when it lowers, untilts and disengages its needles to drop the leading edge of the workpiece onto the conveyor 14.

As conveyor 14 moves the workpiece over the vacuum plenum 18, the vacuum draws the workpiece against the surface of conveyor 14. The leading edge of the workpiece moves with the conveyor 14 until it is sensed by a sensor slightly downstream of face detector 16, at which time the beam from the ultrasonic transmitter 36 is reflected off the facing side of the workpiece and the reflected beam is measured by ultrasonic receiver 38. The ultrasonic receiver 38 generates a voltage which is proportional to the reflectivity of the side of the workpiece facing the face detector 16. The face detector controller 40 compares the voltage to a predetermined threshold value, and sends a signal to the machine controller (not shown) indicating which side is up. As the trailing edge of the workpiece passes a sensor slightly upstream from the face detector 16, a signal is sent to the face detector to stop measuring the reflected ultrasonic beam.

Assuming the face detector senses that the rough (dark) side is up, when the leading edge of the workpiece reaches a predetermined position on the conveyor 14, the rod in drive cylinder 74 is retracted to position the nip between belts 54, 56 off the end of conveyor 14, whereby the leading edge of the workpiece will enter and be drawn into the straight line conveyor unit 26. As the leading edge of the workpiece approaches the output end 24 of the straight line conveyor, the rod in drive cylinder 74 is extended to place the nip between belts 54, 56 in position whereby the leading edge of the workpiece will exit and be deposited on take-away conveyor 30.

As the first workpiece was entering the straight line conveyor 26, a second workpiece was approaching the face detector 16. In the manner described above, the face detector determines that the second workpiece has the smooth side up. Accordingly, as end 24 of the feeder/inverter is pushed up to place the exit end of the straight line conveyor 26 in position to deposit the leading edge of the first workpiece onto conveyor 30, the nip between rollers 59, 59' of the inverter 28 are simultaneously positioned to receive the leading edge of the second workpiece. The leading edge of the second workpiece enters the inverter 28, and, as it travels between the two belt segments, the workpiece is rotated 180 degrees about an axis which lies along its direction of travel. The end 24 of the feeder/inverter 20 is moved down to place the exit end 24 of the inverter 28 in position to deposit the leading edge of the second workpiece, now dark (rough) side up, onto the conveyor 30. At the same time, the nip between belts 54, 56 at end 22 of the straight line conveyor is positioned to receive the expected dark (rough) side up third workpiece.

For elongated workpieces, such as those used for making belt loops, it is possible for a trailing edge portion of the workpiece to still be in the feeder/inverter at the time the feeder/inverter rotates. If this occurs, the workpiece may be dislodged from its position on conveyor 30. To prevent this from occurring, a wiper blade 32, shown in FIG. 1, can be provided and used to remove the tail end of the workpiece from the feeder/inverter 20 and push it to a down-hanging position until the conveyor 30 moves sufficiently to support the entire workpiece.

The invention has been described in terms of the preferred embodiment. One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

We claim:

1. An automatic feeder for removing fabric workpieces from a stack of like workpieces, the workpieces having a first side and a second side, the first side having different surface characteristics from the second side, the workpieces being stacked with alternating sides up, for checking all fabric workpieces to determine the side which is up, and for inverting all workpieces which do not have the desired side up so that all workpieces arrive at a downstream sewing station having the same orientation, the feeder comprising:

a picker means for picking the top workpiece from the stack of workpieces, separating it from the remaining stack, and moving it to a first downstream conveyor;

a face detector mounted above said first conveyor for determining whether the first side or the second side of the workpiece is side up on the first conveyor;

a pivoting feeder/inverter at the end of said first conveyor which can be selectively pivoted in a first direction to provide an input nip at a downstream end of said first conveyor for conveying a workpiece determined to have a desired side up in straight line fashion to an exit nip, and in a second direction to provide an input nip at a downstream end of said first conveyor for conveying and rotating 180 degrees about an axis along the direction of travel a workpiece determined by said face detector to have a desired side down;

a second downstream conveyor at the exit nip of said pivoting feeder/inverter to carry the fabric workpieces to a sewing station; and, a feeder computer/controller for controlling and coordinating the operation of the picker means, the face detector, the feeder/inverter, and the downstream conveyors.

2. The automatic feeder of claim 1 additionally including a hold down means cooperative with said picker means and controlled by said feeder controller, for contacting and holding down a leading edge of a second workpiece in said stack after said picker has engaged a leading edge of a top workpiece in said stack.

3. The automatic feeder of claim 2 additionally including a means for blowing a stream of air between said top workpiece and said second workpiece after said picker has engaged said top workpiece and said hold down means has engaged said second workpiece.

4. The automatic feeder of claim 1 additionally including a plurality of sensors for providing control signals to said feeder controller representative of the position of the stack, the presence or absence of workpieces in the stack, and the position of the picker means.

5. The automatic feeder of claim 1 wherein the first side of each fabric workpiece is relatively rough and wherein the second side of each fabric workpiece is relatively smooth, and wherein said face detector comprises an ultrasonic transmitter, an ultrasonic receiver for receiving a reflected beam generated by said ultrasonic transmitter and reflected off the side of said fabric workpiece facing said face detector, and a detector controller in communication with said ultrasonic receiver and said feeder controller, said detector controller including instructions for comparing said signal from said ultrasonic receiver to a calculated threshold value to determine whether the first side of the fabric workpiece or the second side of the fabric workpiece is facing said face detector.

6. The automatic feeder of claim 5 wherein said detector controller continuously updates the calculated threshold value to correspond to the average difference in surface reflectivity measured from workpieces previously measured by said ultrasonic receiver.

7. The automatic feeder of claim 1 wherein said feeder/inverter includes a straight line feeder comprising a pair of driven sandwich belts.

8. The automatic feeder of claim 1 wherein said feeder/inverter includes a single, endless loop belt having two twists, said belt being mounted on two roller pairs arranged whereby said first roller pair provides an entry nip adjacent to a downstream end of said first conveyor and said second roller pair provides an exit nip adjacent to an upstream end of said second conveyor, said belt disposed to provide two twisted sandwich belt segments between said first and said second roller pairs which rotate through 180 degrees along an axis of travel between said first and said second roller pair.

9. The automatic feeder of claim 1 wherein said feeder/inverter is mounted to, and pivots about, an axle, and additionally includes a drive means for rotating said feeder/inverter on said axle.

10. The automatic feeder of claim 1 additionally including a wiper arm mounted between the feeder/inverter and the second conveyor for pushing a trailing edge of the fabric workpiece out of the feeder/inverter after the leading edge of the fabric workpiece has been placed onto and conveyed away by the second conveyor.

11. An automatic feeder for removing and conveying fabric workpieces from a stack of like workpieces, the workpieces having a first side which has a relatively rough surface and a second side which has a relatively smooth surface, the first side having different surface characteristics from the second side, the workpieces being stacked with alternating sides up, including a picker means for removing a top workpiece from the stack, a dual path conveyor for moving the workpieces towards a sewing station, the dual path conveyor having a straight line path for conveying fabric workpieces without changing their orientation, and an inverting conveyor for turning the fabric workpiece over 180 degrees about an axis along the direction of travel; and a feeder controller for sensing and controlling the movement of the fabric workpieces, the improvement comprising:

an ultrasonic face detector for determining which side of a fabric workpiece is facing said face detector, said face detector including an ultrasonic transmitter, an ultrasonic receiver oriented to receive a reflected beam generated by said ultrasonic transmitter, and a detector controller for receiving a signal from said ultrasonic receiver representative of the reflectivity of the facing side of a fabric workpiece disposed beneath said ultrasonic face detector, for comparing said signal to a threshold value to determine whether the facing side is rough or smooth, and for communicating the identity of the facing side to the feeder controller.

12. The automatic feeder of claim 11 wherein said face detector controller includes a means for storing signals generated by said ultrasonic receiver and a set of instructions for continuously recalculating the threshold value by scanning consecutive pairs of workpieces, storing the two consecutive signals from the workpieces which are representative of one rough side and one smooth side, and recalculating the threshold value as a median between those two readings, and storing the threshold value to be used for comparison with the next two workpieces to pass through the ultrasonic face detector.

13. A method for feeding fabric workpieces one at a time from a stack of like workpieces, the workpieces having a first side and a second side, the first side having different surface characteristics from the second side, the workpieces being stacked with alternating sides up, using a feeding apparatus having a picker means, a first downstream conveyor, a face detector mounted above said first conveyor for determining whether the first side or the second side of the workpiece is side up on the first conveyor, a pivoting feeder/inverter at the end of said first conveyor which can be selectively pivoted to a first position to provide an input nip at a downstream end of said first conveyor for conveying a workpiece determined to have a desired side up in straight line fashion to an exit nip, and to a second position to provide an input nip at a downstream end of said first conveyor for conveying and rotating 180 degrees about an axis along the direction of travel a workpiece determined by said face detector to have a desired side down, a second downstream conveyor at the exit nip of said pivoting feeder/inverter to carry the fabric workpieces to a sewing station, and a feeder controller for controlling and coordinating the operation of the picker means, the face detector, the feeder/inverter, and the downstream conveyors, the method comprising the steps of:

moving the picker means over the stack to engage a leading edge of a top fabric workpiece and remove it from the stack of workpieces;

moving the fabric workpiece to the first conveyor and depositing the leading edge of said fabric workpiece onto said first conveyor whereby it is conveyed downstream and away from said stack;

passing the fabric workpiece under the ultrasonic detector where an ultrasonic beam is reflected off the top surface of the fabric workpiece as it is conveyed on said first conveyor to the ultrasonic receiver to generate a signal which the face detector controller compares to a previously determined threshold value and generates a signal which represents whether the top surface of the fabric workpiece is relatively smooth or relatively rough;

transmitting the signal generated by the face detector controller to feeder controller for a determination of whether the fabric workpiece is correctly oriented for further processing;

if the fabric workpiece is correctly oriented, the feeder controller places the feeder/inverter to the first position, and if the fabric workpiece is not correctly oriented, the feeder controller places the feeder/inverter in the second position;

moving the fabric workpiece on the first conveyor and into the correct nip of the feeder/inverter;

convey the fabric workpiece through the feeder/inverter; and, moving the feeder/inverter to the alternative position to align a leading edge of the fabric workpiece with the second conveyor as the fabric workpiece exits the feeder/inverter.

14. The method of claim 13 including an additional step of activating a wiper arm mounted at the exit of the feeder/inverter to completely remove a trailing edge of the fabric workpiece from the feeder/inverter after the leading edge has been moved away by the second conveyor.

* * * * *